United States Patent [19]

Girard

[11] Patent Number: 4,679,813

[45] Date of Patent: Jul. 14, 1987

[54] SKI STIFF IN TORSION

[76] Inventor: Donald A. Girard, P.O. Box 172, Rancho Cordova, Calif. 95670

[21] Appl. No.: 850,280

[22] Filed: Apr. 10, 1986

[51] Int. Cl.[4] ..... A63C 5/07
[52] U.S. Cl. ..... 280/602
[58] Field of Search ..... 280/601, 602, 607, 610; 138/103, 106, 124, 125, 126, 127

[56] References Cited

U.S. PATENT DOCUMENTS

| | | | |
|---|---|---|---|
| 2,377,504 | 6/1945 | Lermont | 280/601 |
| 4,035,000 | 7/1977 | Lacroix | 280/610 |
| 4,221,400 | 9/1980 | Powers | 280/602 |
| 4,409,287 | 10/1983 | Harrison | 280/601 |
| 4,592,567 | 6/1986 | Sartor | 280/602 |

FOREIGN PATENT DOCUMENTS

| | | | |
|---|---|---|---|
| 3236016 | 4/1984 | Fed. Rep. of Germany | 280/601 |
| 2527460 | 12/1983 | France | 280/602 |

*Primary Examiner*—John J. Love
*Assistant Examiner*—Eric Culbreth
*Attorney, Agent, or Firm*—Owen, Wickersham & Erickson

[57] ABSTRACT

A ski that is stiff in torsion and is flexible in the vertical direction. The ski body that is relatively weak and flexible both in beam and in torsion, having a ski binding area in between its ends for affixation of a user's ski boot, providing forward and rear top surface portions. At least one tubular elastomeric member is rigidly secured atop said ski body, it may be on said forward surface portion, or on said rear surface portion, or on both surface portions, the tubular member being provided with reinforcing comprising helically wound braiding of high-tensile-strength filaments.

11 Claims, 8 Drawing Figures

SKI STIFF IN TORSION

This invention relates to an improved snow ski.

BACKGROUND OF THE INVENTION

Skis have various characteristics that affect the ease of skiing and the ability of the skier to achieve or to fail to achieve a high level of proficiency. Thus, a good ski exhibits straight line stability at high speed, and also the ability to turn easily and to absorb bumps and ripples in the snow. In addition, it should show an ability to traverse across a steep slope without side slip.

Skis include a core, which may be made of any of various materials, such as wood, foam, honeycomb, and various laminated materials. The core controls most of the resilience of the ski.

The bottom surface of the ski is preferably made of a material which is slick, such as a suitable plastic that slides well over the snow, and this bottom portion is bonded to the bottom of the core.

The sides and the top of the ski may be of wood, or of plastic, or metal, but are usually of a type of material different from the bottom, because slipping and sliding is not their function. The sides and top are also bonded to the core, and are preferably surrounded with a waterproof covering, which may also provide decoration.

The bottom is usually provided with metal edges that function to cut into the ice or hard snow so that the ski can bite and can hold a turn without sliding sideways. These metal edges also help when traversing a slope, and when the skier wishes to stop. The skier himself causes these metal edges to bite into the snow by angling his legs, and thus the skis, in the direction of the turn.

Good skis are usually narrower in the center than at the tips when viewed in plan, so that the sides to which the metal edges are affixed form a large arc. This arc helps to cause the ski to start turning when it is angled. The longer the portion of the metal edge that cuts into the snow, the more lateral force the ski can exert to enable the skier to turn sharper and more quickly. Skis are limber and do not twist uniformly along their length when the skier angles them to turn.

Heretofore, such skis have been weak in torsion, so that the tips, the front, and the rear would not angle as much as did the center where the ski boot is attached, as by bindings. This weakness in torsion has forced skiers to accentuate the angularity of their legs, and the ends of the ski did not achieve the same edge hold that would have been obtained if the ski had not twisted. Such a twisted ski could not exert the amount of force on a turn that an untwisted ski could, and thus became a source of inefficiency.

Another important quality in skis is their compliance, their flexurability in the vertical direction. A highly compliant ski makes the ride smoother over the snow, enables the skier to maintain his balance more easily, and achieves a relatively even distribution of pressure along the length of the ski as applied to its bottom surface. Pressure along this bottom surface is a factor in making skis run fast. Areas of extreme pressure due to low compliance are certainly undesirable.

While a ski could be made to be very stiff in torsion by making it much thicker, it would then be much less compliant when moving over ripples and bumps and deep depressions in the snow, so that the overall result would be unsatisfactory. The compliance of a ski relates to its stiffness or flexibility in beam. A very thick ski would be relatively stiff and not compliant. However, it is desirable to have high compliance, and so it is desirable for a ski to be relatively weak in beam. On the other hand, twisting of the ski takes place because a typical ski is very weak in torsion. Both types of action —compliance and torsion — may occur separately or simultaneously, depending on the terrain and on the action of the skier.

In the past skis have been relatively weak in both beam and torsion. It would be easy, as indicated earlier, to make such a ski stiff in both beam and in torsion, but it has been believed that it would be nearly impossible to make the ski weak in beam and yet stiff in torsion. However, this is what is basically desired in a ski.

An object of the present invention is to accomplish stiffness in torsion, while leaving the beam flexible, or relatively weak, so that the beam strength is relatively low, but the torsion stiffness is high.

Another object of the invention is to enable a designer to control each of the two factors, torsion and beam strength, almost independently of each other. Usually this can be effected by starting with a ski design that is weak in beam and weak in torsion, and then by applying the principles of the present invention, the torsional rigidity can be increased without substantially affecting the beam flexibility.

SUMMARY OF THE INVENTION

The present invention may start with a ski of typical good current design, which is relatively weak or flexible, both in beam and in torsion. Hose-like tubular members having helically wound filaments are then placed at a forward portion of the ski or at a rearward portion, or both, i.e., ahead and/or behind the area where the ski boot will be placed. These special tubular members may comprise a hose of natural or synthetic elastomer with braided strands of high-tensile-strength strands or filaments of such material as steel, fiberglass, or carbon fiber, densely wound around or embedded in the elastomer.

As the ski flexes in beam, the tube, which is flexible, so far as this kind of force is concerned, offers no additional resistance. However, when the ski is subjected to a high torque, i.e., a twisting force, the high-tensile-strength winding resists this twist, and it imparts its stiffness in torsion to the ski itself, so that the ski is relatively stiff in torsion, even though it is still relatively weak or flexible in beam.

Other objects and advantageous of the invention will appear from the following description of a preferred embodiment.

DESCRIPTION OF A PREFERRED EMBODIMENT

Figures 1, 2, 3, 4, 5, 6, 7, 8:
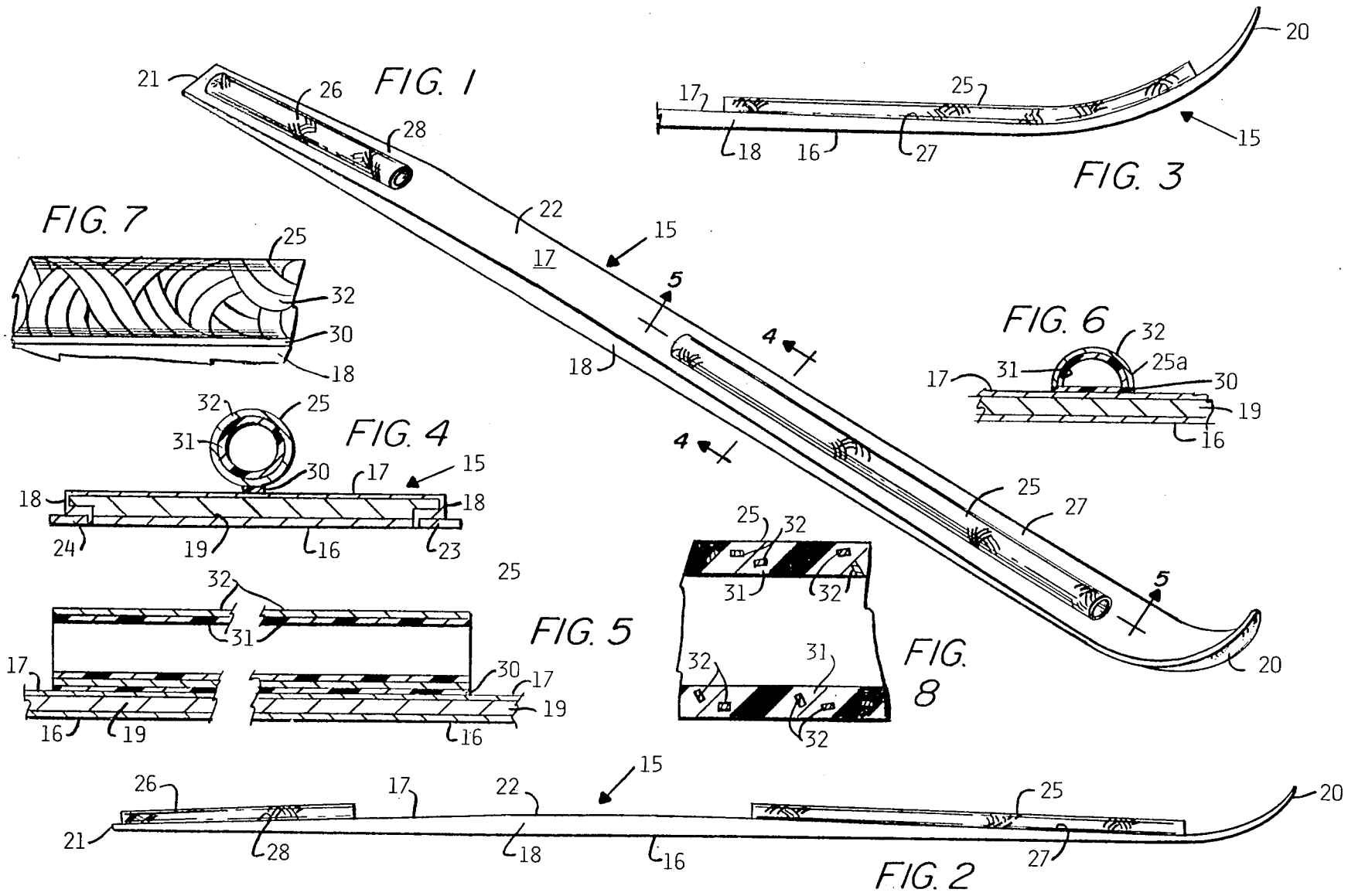
FIG. 1 is a view in perspective of a ski embodying the principles of the invention.
FIG. 2 is a view in side elevation of the ski of FIG. 1.
FIG. 3 is a fragmentary view in side elevation of the front portion of the ski in which the turned-up front is being flexed upwardly.
FIG. 4 is an enlarged view in section along the line 4—4 in FIG. 1.
FIG. 5 is a view in section taken along the line 5—5 in FIG. 1.
FIG. 6 is an enlarged view in section like FIG. 4 but with a modified form of tube that is flattened.
FIG. 7 is an enlarged view in side elevation of a portion of a tube like that in FIGS. 4 and 5.
FIG. 8 is a further enlarged view like FIG. 4 but with the helical winding embedded in the elastomeric tube.

The drawings show a ski body 15 having a slick bottom surface 16, a top surface 17, and side surfaces 18, the top and side surfaces 17 and 18 helping to protect a core 19. The ski has a turned up forward end 20 and a rear end 21. In between these two ends is an area 22 for placing the boot and bindings. The ski 15 is preferably wider at its front end 20 and at its rear end 21 than at the area 22 in between them. Along the bottom edges are sharp metal inserts 23 and 24 (See FIG. 4).

In the present invention the top surface 17 is provided with one or, preferably, two filament-wound hose members 25 and 26. Thus, preferably, there may be both a forward hose member 25 secured rigidly on top of the ski on a forward area 27 and a rear hose member 26 on a rear area 28, or there may be only one such hose member, either fore or aft. Seen in transverse cross section these hose members 25 and 26 may be either circular (FIG. 4) or may be a substantially semicircular member 25*a* (FIG. 6). Each hose 25 or 26 may be secured to the ski upper surface by a bottom portion or strip 30 (FIG. 4), or adhesively secured (FIG. 6) or by the edges of the semi-circle of FIG. 6 or by an arcuately extending flange or pair of flanges.

The hose 25, 25*a*, or 26 has a body 31 which can be of any elastomeric material such as rubber, neoprene, or polyurethane, with braided helically wound strands 32 either embedded in the elastomer (FIG. 8), or surrounding it (FIG. 7). In any case, torque is resisted by the helical wound material 32 (sometimes called filament wound) of a high tensile strength. This could be steel or fiberglass or carbon fiber, etc.

The elastomeric material provides a body 31 that is strong in radial compression to support the fiber 32 and to keep it from collapsing. Yet, being flexible axially, it can bend with the ski 15. The filament winding 32 could be either in one direction or cross wound.

Instead of an attachment to an already made ski, the tube 25, 25*a*, or 26 may be a part of the ski itself.

Such a tube 25, 25*a* or 26 offers no resistance vertically; so that the ski can be flexed and therefore allow motion between the center portion 22 of the ski and its ends 20 and 21, in order to provide the desired compliance. Thus, when the ski 15 is flexed, as for example in FIG. 3, the hose 25, 25*a* or 26 does not resist this flexure.

However, the member 25, 25*a* or 26 is not easily twisted, being relatively stiff in torsion because of the high-tensile-strength helical winding. Therefore, this member 25, 25*a* or 26 strongly resists twisting forces. The front and rear members act similarly, although the rear member 26 may be somewhat shorter, and may, in fact, in some embodiments be omitted if that is desired, since the principal flexure takes place at the front. Similarly, the front member 25 may be omitted if desired.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A ski that is stiff in torsion and is flexible in the vertical direction, comprising a ski body that is compliant both in beam and in torsion, having a bottom surface and a top surface, a curved-up front end, a rear end, and a ski binding area in between its ends for affixation of a user's ski boot, providing a forward top surface portion and a rear top surface portion, at least one hollow elastomeric tubular hose supporting and reinforced by tightly helically wound braiding of high-tensile-strength filaments, rigidly secured to an upper surface portion said ski body, said hose extending lengthwise.

2. The ski of claim 1 wherein said hose is circular in cross-section and is secured firmly to the ski body along a bottom portion.

3. The ski of claim 1 wherein said hose is semicircular in transverse cross-section and has a base strip which is rigidly secured to the ski body.

4. The ski of claim 1 wherein said braiding is of steel filaments.

5. The ski of claim 1, wherein said braiding is of fiberglass.

6. The ski of claim 1 wherein said braiding is of carbon fiber.

7. The ski of claim 1 wherein there are two said hoses, one secured to said forward top surface and one secured to said rear top surface.

8. A ski that is stiff in torsion when submitted to a torque and is flexible in the vertical direction, comprising a ski body that is compliant both in beam and in torsion, having a bottom surface and a top surface, a curved-up front end, a rear end, and a ski binding area in between its ends for affixation of a user's ski boot, providing a forward top surface portion and a rear top surface portion, a pair of longitudinally extending hollow tubular elastomeric members rigidly attached atop said ski body, each said member extending longitudinally of said ski, one on said forward surface portion, one on said rear surface portion, each said member having a reinforcing helically wound external braiding of high-tensile-strength filaments.

9. The ski of claim 8 wherein each said member is semicircular in transverse cross-section.

10. The ski of claim 9 wherein said semicircular member has a base and has means for adhesively securing it to the ski body.

11. The ski of claim 8 wherein each said member is circular in transverse cross-section.

* * * * *